US009766642B2

(12) United States Patent
Pons

(10) Patent No.: US 9,766,642 B2
(45) Date of Patent: Sep. 19, 2017

(54) LOW-DROPOUT REGULATOR

(75) Inventor: Alexandre Pons, Vizille (FR)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 681 days.

(21) Appl. No.: 13/383,941

(22) PCT Filed: Jul. 15, 2010

(86) PCT No.: PCT/EP2010/060263

§ 371 (c)(1),
(2), (4) Date: Jan. 13, 2012

(87) PCT Pub. No.: WO2011/006979

PCT Pub. Date: Jan. 20, 2011

(65) Prior Publication Data

US 2012/0112718 A1 May 10, 2012

(30) Foreign Application Priority Data

Jul. 16, 2009 (FR) ..... 09 54924

(51) Int. Cl.
*G05F 1/575* (2006.01)
*G05F 1/573* (2006.01)

(52) U.S. Cl.
CPC ..... *G05F 1/575* (2013.01); *G05F 1/573* (2013.01)

(58) Field of Classification Search
CPC . G05F 1/56; G05F 1/575; G05F 1/573; G05F 1/565; H02M 3/156; H02M 3/335; H02M 2001/0045
USPC ..... 323/273, 274, 280, 281, 303
See application file for complete search history.

(56) References Cited

U.S. PATENT DOCUMENTS

| | | | | |
|---|---|---|---|---|
| 6,201,375 | B1 | 3/2001 | Larson | |
| 7,737,676 | B2 * | 6/2010 | Kimura | G05F 1/56 323/315 |
| 7,855,537 | B2 * | 12/2010 | Aizawa | 323/277 |
| 7,986,499 | B2 | 7/2011 | Wang et al. | |
| 8,044,653 | B2 * | 10/2011 | Maige | G05F 1/575 323/313 |
| 8,089,261 | B2 * | 1/2012 | Lipka | 323/315 |
| 2003/0147193 | A1 | 8/2003 | Hamon et al. | |
| 2005/0275394 | A1 * | 12/2005 | Moraveji et al. | 323/312 |
| 2007/0216383 | A1 | 9/2007 | Al-Shyoukh | |
| 2007/0268008 | A1 * | 11/2007 | Gicquel et al. | 323/280 |

(Continued)

FOREIGN PATENT DOCUMENTS

| | | | |
|---|---|---|---|
| CN | 101256421 | A | 9/2008 |
| JP | 2007226392 | A | 9/2007 |

*Primary Examiner* — Emily P Pham
*Assistant Examiner* — Shahzeb K Ahmad
(74) *Attorney, Agent, or Firm* — Coats & Bennett, PLLC

(57) ABSTRACT

A low-dropout voltage regulator comprises an output terminal for providing an output voltage regulated as a function of a reference voltage, and for providing an output current, and additionally comprising an output current limiting unit. The current limiting unit comprises a replicator for replicating the output current to provide a mirror current of the output current, a comparator circuit for comparing the mirror current with a reference current, and a feedback circuit for supplying feedback to the regulator in order to limit the output current when the mirror current is greater than the reference current. The mirror current is injected into the output terminal.

5 Claims, 4 Drawing Sheets

(56) References Cited

U.S. PATENT DOCUMENTS

| | | | | |
|---|---|---|---|---|
| 2009/0015070 | A1* | 1/2009 | Dobkin | 307/55 |
| 2009/0046404 | A1 | 2/2009 | Morino | |

* cited by examiner

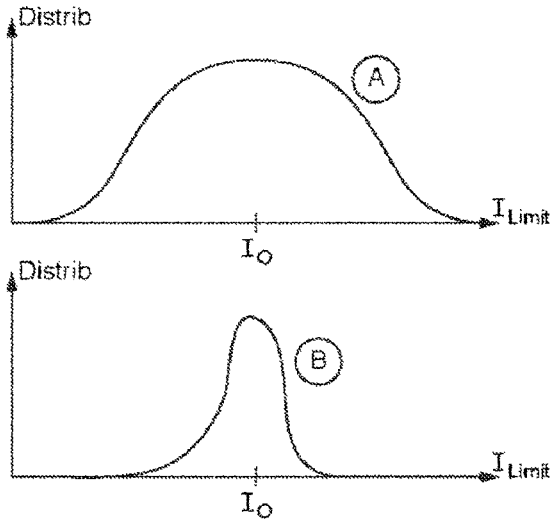
FIG. 4
FIG. 5
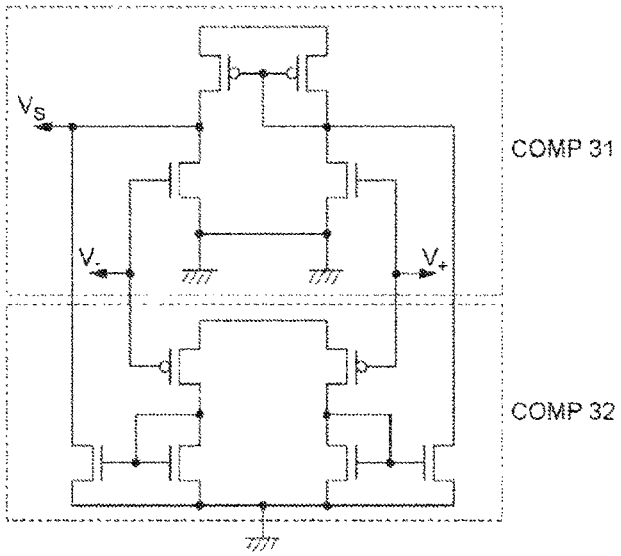

LOW-DROPOUT REGULATOR

TECHNICAL FIELD

The present invention relates to Low-Dropout (LDO) voltage regulator circuits.

More particularly it concerns the limiting of short circuit current in such regulators.

TECHNOLOGICAL BACKGROUND

An LDO regulator allows providing a stable output voltage in spite of fluctuations in the general supply voltage of the circuit in which it is installed.

When a circuit containing an LDO regulator is powered up, or when there is an accidental short circuit of the regulator output, it is necessary to limit the output current to avoid malfunctions.

In order to limit this short circuit current, one can consider the use of dedicated current-limiting circuits. These circuits would consist of a feedback loop which measures the output current of the regulator, then compares it to a reference current in order to act on the regulator when the output current becomes greater than the reference current.

Such a current-limiting circuit is shown in FIG. 1.

In this circuit, one can see two particular functional units. The first unit REGUL1 represents the voltage regulating loop of the regulator. This regulating loop allows maintaining a stable output voltage $V_{out}$. The second unit LIMIT1 represents the current-limiting loop.

In what follows, only the current-limiting loop is considered. A person skilled in the art is able to understand the operation of the regulating loop when reading the circuit.

In order to access the output current $I_{out}$, a PMOS copy transistor T10 is arranged such that it copies the output current issuing from the PMOS power transistor T11.

In order to simplify the presentation, the current from the transistor T11 almost entirely flows to the output, so for practical means it is the output current. The current drawn by the resistors of the regulating loop is negligible compared to the current issuing from the transistor.

The transistors T10 and T11 are paired transistors on silicon and are arranged such that the gate of T10 is connected to the gate of T11, and the source of T10 is connected to the source of T11.

Thus the drain current $I_{mirror}$ of the transistor T10 is proportional to the drain current $I_{out}$ of the transistor T11.

The transistors T10 and T11 have the same physical properties. In particular, they have the same gate length L. However, they have different gate widths W10 and W11. In fact, the width W11 of the gate of T11 is much greater than the width W10 of the gate of T10.

Thus by using the linear model for MOS transistors, we have:

$$I_{out} = \frac{W_{11}}{W_{10}} \cdot I_{mirror}.$$

The drain of the transistor T10 is coupled to the non-inverting input of a comparator COMP1 as well as to a resistor $R_{10}$. The inverting input of the comparator is coupled to a reference current source $I_{ref}$ in parallel with a second resistor $R_{11}$. The two resistors $R_{10}$ and $R_{11}$ each have a grounded end. For example, they have the same R value.

Thus the output $V_{s10}$ of the comparator COMP1 is a voltage proportional to the difference between the current $I_{mirror}$ (which is proportional to the output current $I_{out}$) and the reference current Iref. The coefficient of proportionality is the product of the resistor R and the gain $G_{10}$ of the comparator.

The output from the comparator is coupled to the gates of the PMOS transistors T10 and T11. Thus, using the small signal model, the current $I_{out}$ is proportional to the voltage output from the comparator, with the coefficient of proportionality being the gain $G_{mp}$ of the transistor T11.

One can therefore model the signals in the following manner:

$$V_{s10}=G_{10}\cdot R\cdot(I_{mirror}-I_{ref})$$

$$I_{out}=-G_{mp}\cdot V_{s10}.$$

Lastly one can express $I_{out}$ as a function of $I_{ref}$, using:

$$I_{out} = \frac{w_{11}}{w_{10}} \frac{G_{mp} \cdot G_{10} \cdot R}{G_{mp} \cdot G_{10} \cdot R + 1} \cdot I_{ref}.$$

As the open-loop gain $G_{mp}\cdot G_{10}\cdot R$ is very high, one can simplify the expression for $I_{out}$ as follows:

$$I_{out} = \frac{w_{11}}{w_{10}} \cdot I_{ref}.$$

One can therefore see that it is possible to set the output current, through the choice of the values for $I_{ref}$ and $W_{10}$.

The current consumption is very high in this current-limiting loop. In addition, this consumption grows even greater as the size of the power transistor T11 decreases.

A few values are given below to illustrate this.

TABLE 1

| | |
|---|---|
| Current consumed by the comparator COMP1 | $I_{ad}$ = 4 μA |
| Output current | $I_{out}$ = 200 mA |
| Reference current | $I_{ref}$ = 1 μA |
| Width of gate of transistor T11 | $W_{11}$ = 32 000 μm |
| Width of gate of transistor T10 | $W_{10}$ = 10 μm |
| Length of gate of transistors $T_{10}$ and $T_{11}$ | L = 0.2 μm |

The current $I_q$ consumed by the current-limiting loop can be approximated by adding the reference current, the mirror current, and the current consumed by the comparator:

$$I_q=I_{ref}+I_{ad}+I_{mirror}$$

which is:

$$I_q = I_{ref} + I_{ad} + \frac{W_{10}}{W_{11}} I_0.$$

Using the numbers in the above table, one obtains a current $I_q$=67.5 μA.

The specifications for LDO regulators impose a current consumption of less than 150 μA. The current-limiting loop therefore already consumes close to half of the objective.

In order to reduce this consumption, one can reduce W10. However, the topography of the circuit does not allow much reduction in this parameter. One can also consider increasing $W_{11}$. However, there is almost no room for adjustment here because the output current depends on W11.

In addition, the accuracy of the current-limiting loop is very low because the pairing of the transistors T10 and T11 is made difficult by their difference in surface area which can have a ratio as high as 2000 or more.

FIG. 2 illustrates the topography of these transistors in the LDO circuit. One can see that it is difficult to pair these two transistors because almost the entire surface area of the silicon is occupied by T11.

The precision of the current-limiting loop can be estimated in comparison to the accuracy of the copying of the current by the transistor T10. The standard deviation is calculated on the relative error in the recopying of the current, and the accuracy of the recopying is estimated as six times this standard deviation. Then the accuracy is expressed as:

$$acc = 6 \cdot \sqrt{\frac{4 \cdot \frac{A_{vt}^2}{V_{gt}^2} + A_\beta^2}{2 \cdot W_{10} \cdot L}},$$

where $V_{gt}$: the difference in voltage between the gate and the source of the transistor T10 on the one hand and the threshold voltage of the transistor on the other, and $A_{vt}$ and $A_\beta$: parameters of the circuit.

The accuracy was calculated for several circuits with the same parameters and for different values of $W_{10}$, L, and $V_{gt}$.

The results are presented in the following table.

TABLE 2

| Circuit | $A_{vt}$ (mV · μm) | $A_\beta$ (% · μm) | $W_{10}$ (μm) | L(μm) | $V_{gt}$ (mV) | Acc |
|---|---|---|---|---|---|---|
| 1 | 9.4 | 0.032 | 10 | 0.6 | 200 | 0.24 |
| 2 | 9.4 | 0.032 | 15 | 0.6 | 367 | 0.12 |
| 3 | 9.4 | 0.032 | 10 | 0.6 | 207 | 0.23 |
| 4 | 9.4 | 0.032 | 5 | 0.6 | 434 | 0.18 |
| 5 | 9.4 | 0.032 | 20 | 0.6 | 190 | 0.23 |
| 6 | 9.4 | 0.032 | 10 | 0.6 | 180 | 0.27 |

The accuracy ranges from 12% to 27%. This level of accuracy is low, and does not take into account the effects of temperature and voltage offsets. When such phenomena are taken into account, the result is an even lower accuracy.

SUMMARY OF THE INVENTION

Therefore a need exists for an LDO regulator comprising a current-limiting loop that offers good accuracy and has reduced current consumption.

For this purpose, a low-dropout voltage regulator is proposed that comprises an output terminal for providing an output voltage regulated as a function of a reference voltage, and for providing an output current, and that additionally comprises an output current limiting unit. The unit comprises:

- replication means for replicating the output current to provide a mirror current of the output current,
- comparison means for comparing the mirror current with a reference current,
- feedback means for supplying feedback to the regulator in order to limit the output current when the mirror current is greater than the reference current.

In addition, the mirror current is injected into the output terminal.

In this manner the mirror current which is used for the purposes of measuring the output current is not consumed by the current-limiting unit.

Advantageously, the invention proposes including this current in the output current.

As a comparison, in the limiting loop described with reference to FIG. 1, the mirror current was drawn by the ground of the circuit, and was therefore completely consumed by the limiting loop.

With a regulator of the invention, it is possible to save significant amounts of current, which facilitates the design of LDO regulators. The current consumption of the current-limiting loop constituted a very large part of the current consumed by regulators of the prior art.

In addition, the regulator of the invention allows more precise limiting of the current.

The current consumed by the current-limiting unit does not depend on a means of replicating the output current. Therefore, unlike the circuit in FIG. 1, the replication means do not introduce inaccuracy.

In some embodiments, the reference current is injected into the output terminal.

This allows further reduction of the current consumption.

As a comparison, the reference current of the circuit in FIG. 1 is drawn by the ground once it has traversed the resistor R11. It is therefore completely consumed by the current-limiting loop.

In some embodiments, the comparison means comprises:

- a first input coupled to a first electric potential which is a function of the output voltage and the intensity of the mirror current, and
- a second input coupled to a second electric potential which is a function of the output voltage and the intensity of the reference current.

It is thus possible to compare the mirror current and the reference current by comparing the first and second potentials without drawing, and therefore consuming, said currents.

According to some embodiments:

- the output terminal is the drain of a first PMOS power transistor,
- the replication means of the output current comprises a second PMOS transistor paired with the first transistor, with the gate of the first transistor being connected to the gate of the second transistor and the source of the first transistor being connected to the source of the second transistor,
- the output from the comparator is coupled to the gates of the first and second transistors.

The regulator additionally comprises:

- a first resistor arranged between the output terminal and the first input of the comparator, and
- a second resistor arranged between the output terminal and the second input of the comparator.

In these embodiments it is possible to create replication (or copy) transistors that have a significant gate surface area. This facilitates pairing with the power transistor.

In addition, in these embodiments, there is great flexibility in the choice of parameters that set the limit for the output current.

The design of the regulator is therefore facilitated.

The invention also provides for a method for controlling a regulator, a computer program comprising instructions for implementing the method, and a device comprising a regulator according to the invention.

These objects present at least the same advantages as those provided by the regulator of the invention.

BRIEF DESCRIPTION OF THE DRAWINGS

Other features and advantages of the invention will become apparent from the following description. This description is purely illustrative and is to be read in light of the attached drawings, in which, in addition to FIGS. 1 and 2:

FIG. 4 illustrates the gain in accuracy provided by a circuit according to an embodiment of the invention;

FIG. 5 illustrates an embodiment of the comparators COMP31 and COMP32 of FIG. 3

DETAILED DESCRIPTION OF EMBODIMENTS

A circuit according to an embodiment of the invention is described below, first with reference to FIG. 3.

The circuit is represented in this figure, in which a regulating loop REGUL3 and a current-limiting loop LIMIT3 can be recognized.

The regulating loop comprises two resistors in series R31 and R32 connecting the output voltage Vout to the ground. The node between the resistors R31 and R32 is coupled to the inverting input of a comparator COMP33. The non-inverting input of this comparator is coupled with a reference voltage source Vref Thus the output voltage from the comparator COMP33 is a linear combination of the output voltage Vout and the reference voltage Vref. This is equivalent to comparing the output voltage to a reference voltage Vref' whose value is a function of the reference voltage Vref and the value of the resistors R31 and R32. The output voltage of the comparator COMP33 can be written as:

$$V_{s33} = G_{33} \cdot \frac{R31}{R31 + R32} \cdot \left(V_{OUT} - \frac{R31 + R32}{R31} \cdot V_{ref}\right),$$

where $G_{33}$ is the gain of the comparator COMP33.

The output voltage of the comparator COMP33 is coupled to the gate of a NMOS transistor T32. The drain of this transistor T32 is connected to the ground and the source of this transistor is connected to the gates of transistors T30 and T31 described below.

The current-limiting loop comprises a PMOS power transistor T30, and a PMOS copy transistor T31.

The transistors T30 and T31 are paired on silicon and arranged such that the gate of T30 is connected to the gate of T31, and the source of T30 is connected to the source of T31.

Thus the drain current $I_{mirror}$ of the transistor T31 is proportional to the drain current of the transistor T30. In order to simplify the presentation, the drain current of the transistor T30 is considered to be equal to the output current $I_{out}$. In fact, in practice, the other currents at the output node of the circuit are negligible compared to $I_{out}$.

The current $I_{mirror}$ is not lost because it is injected into the output via a resistor R33.

In addition, the reference current Iref used for the limiting loop is also injected into the output via a resistor R34.

The limiting loop comprises two comparators COMP31 and COMP32, associated such that the output of COMP31 is connected to the output of COMP32, the inverting input of COMP31 is connected to the inverting input of COMP32, and the non-inverting input of COMP31 is connected to the non-inverting input of COMP32.

Figure 1:
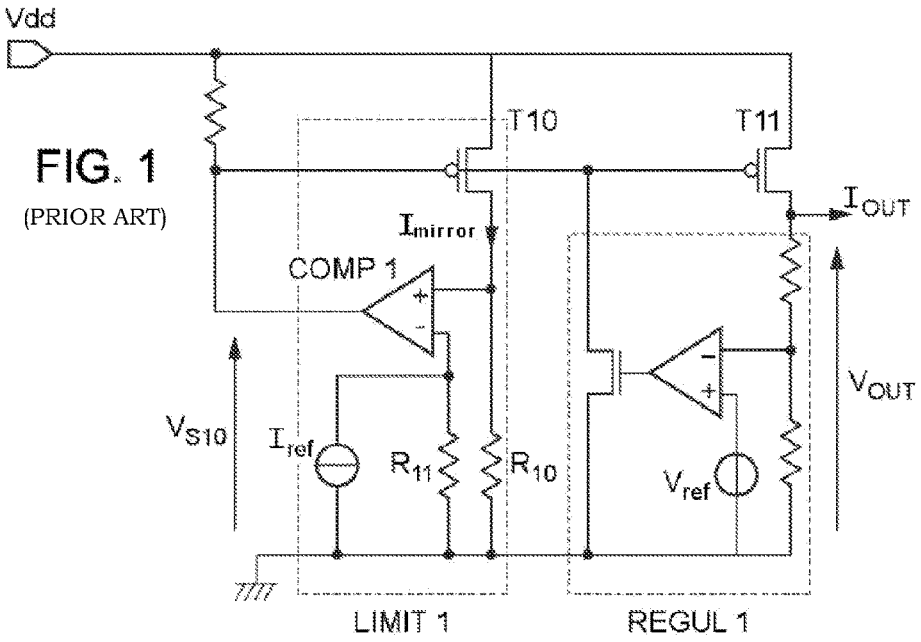
FIG. 1 (PRIOR ART)
Figure 2:
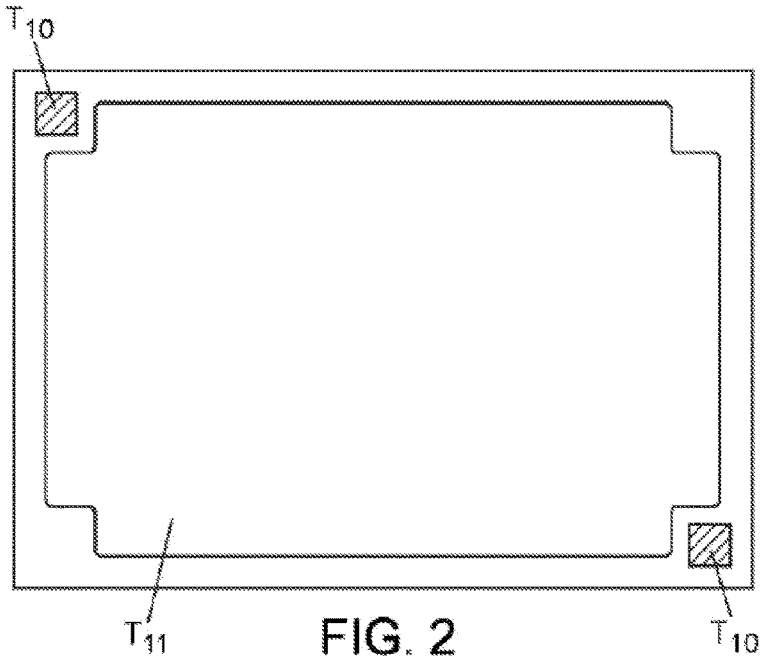
FIG. 2 (PRIOR ART)
Figure 3:
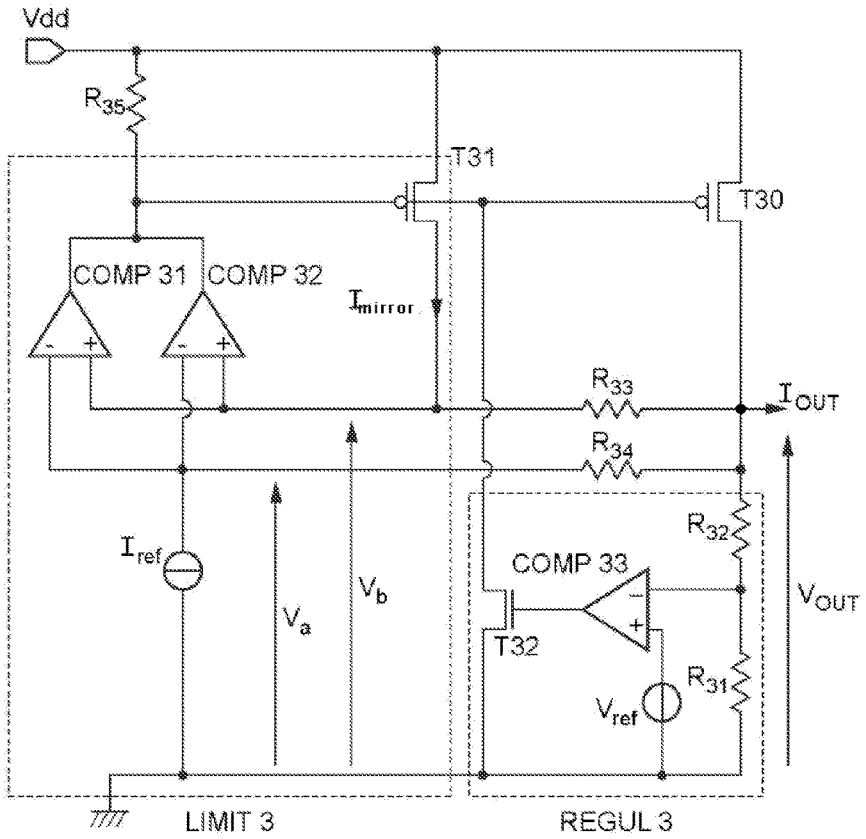
FIG. 3 illustrates an LDO regulator comprising a current-limiting loop according to an embodiment of the invention.

Unlike the comparator COMP1 of FIG. 1, the comparators COMP31 and COMP32 of FIG. 3 do not use the ground as a reference. Their reference is the output voltage. As this voltage is variable and not always close to 0 (varying for example between 0 Volts and 3.3 Volts), a larger working range must be allowed for, which is what the association of the two comparators COMP31 and COMP32 does.

They are additionally arranged such that when the value of the voltage Va between the ground and the inverting input of the comparators is less than half of the supply voltage Vdd it is the comparator COMP31 which operates, and when this voltage Va is between Vdd/2 and Vdd, it is the comparator COMP32 which operates.

As will be clear to a person skilled in the art, the association of these two comparators is equivalent to one comparator.

The outputs from comparators COMP31 and COMP32 are coupled to the gates of transistors T30 and T31 and to a resistor R35 for switching between the regulating and current-limiting loops. The resistor R35 connects the output of the comparators COMP31 and COMP32 to the supply voltage potential Vdd.

In what follows, simplified calculations are used to illustrate the savings in current and the gain in accuracy realized by the circuit described above.

The following notations are used:

Vb: drain potential of the transistor T31

$W_{31}$: Width of the gate of the transistor T31

$W_{30}$: Width of the gate of the transistor T30

$G_{mp30}$: gain of the transistor T30

G31: gain of the comparator COMP31

G32: gain of the comparator COMP32.

The transistors T30 and T31 have the same physical characteristics. In particular, they have the same gate length. Using the linear model for transistors, one obtains:

$$I_{mirror} = \frac{W_{31}}{W_{30}} \cdot I_{out}.$$

In addition:

$$V_a = V_{out} + R_{34} \cdot I_{ref}, \text{ and}$$

$$Vb = V_{out} + R_{33} \cdot I_{mirror}, \text{ or } Vb = V_{out} + R_{33} \cdot \frac{W_{31}}{W_{30}} \cdot I_{out}.$$

When $$\frac{V_{dd}}{2} \leq V_a \leq V_{dd},$$

the comparator COMP31 operates and one obtains:

$$Vs = G_{31} \cdot (V_b - V_a)$$

$$V_s = -\frac{I_{OUT}}{G_{mp30}}.$$

Which leads to:

$$G_{31}\cdot\left(R_2\frac{W_{31}}{W_{30}}\cdot I_{OUT}-R_{34}\cdot I_{ref}\right)=-\frac{I_{OUT}}{G_{mp30}}.$$

After simplification one obtains:

$$I_{out}=\frac{R_{33}\cdot G_{31}\cdot G_{mp30}}{1+R_{33}\cdot G_{31}\cdot G_{mp30}}\cdot\frac{W_{30}}{W_{31}}\cdot\frac{R_{34}}{R_{33}}\cdot I_{ref}.$$

As the open-loop gain $R_{33}\cdot G_{31}\cdot G_{mp30}$ is very high, one arrives at the following approximation:

$$I_{out}=\frac{W_{30}}{W_{31}}\cdot\frac{R_{34}}{R_{33}}\cdot I_{ref}.$$

When $$0\le V_a\le\frac{V_{dd}}{2},$$

the comparator COMP32 operates, and with the same type of reasoning as for the above case, the same result is reached.

One can see that there is a set of three parameters W31, R33, R34 for setting the output current.

In the current-limiting loop LIMIT3, the current consumed corresponds to the current consumed by the comparators COMP31 and COMP32. If these currents are considered to be equal, and comparable to the current consumed by the comparator COMP1 of FIG. 1, a savings of current corresponding to $$I_{ref}-I_{ad}+\frac{W_{10}}{W_{11}}I_0$$

is observed. Applying the numbers from Table 1, a consumption of 8 μA is found. This current consumption is to be compared with the 67.5 μA of the circuit in FIG. 1. A clear savings in current consumption is found.

In addition, in this solution, the current consumed no longer depends on the width of the transistors T30 and T31 (only the currents of the comparators are consumed). It is therefore possible to increase the surface area of the gate of the transistor T31 which improves its pairing with the transistor T30, and which therefore improves the accuracy of the current loop. In fact, the accuracy of the copy transistor is inversely proportional to the square root of the surface area of this transistor (see the expression for acc given above).

FIG. 4 illustrates the accuracy of circuits according to FIG. 1 as curve A, and the accuracy of circuits according to embodiments of the invention as curve B.

For a same short-circuit current limit value $I_0$, the y axis plots the number of circuits offering effective limiting to a given current limit value.

The distribution of circuits is Gaussian, centered around $I_0$. One can see that for circuits according to embodiments of the invention, the Gaussian curve is more narrow, which clearly illustrates the gain in accuracy in comparison to the limiting loops of FIG. 1.

FIG. 5 illustrates an embodiment of the comparators COMP31 and COMP32 described above with reference to FIG. 3.

The comparators are operational amplifiers. The comparator COMP32 operates for low voltages, and the comparator COMP31 operates for high voltages.

$V_s$ represents their common output, V− their common inverting input, and V+ their common non-inverting input.

A method for controlling a regulator is described with reference to FIG. 6. First the current $I_{mirror}$ is generated during a step of copying the output current S60. The mirror current is then compared to the reference current during the step S61. If during the step T62 it is determined that the mirror current is greater than the reference current, a means of supplying feedback to the regulator is brought into play during the step S63 in order to limit the output current.

Lastly, in a final step S64, the mirror current is injected into the regulator output. During this step, the reference current can also be injected.

Figure 6:
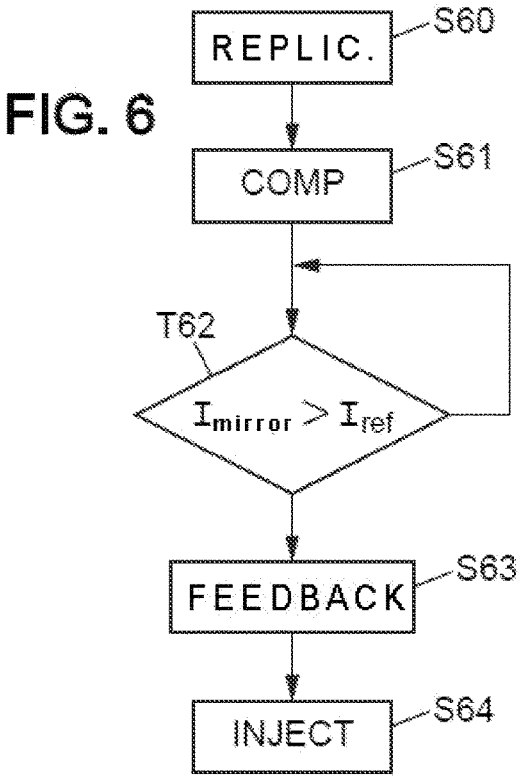
FIG. 6 is a flow chart of the steps for implementing the method according to an embodiment of the invention.

A computer program comprising instructions for implementing the method can be deduced from the general flowchart in FIG. 6.

Figure 7:
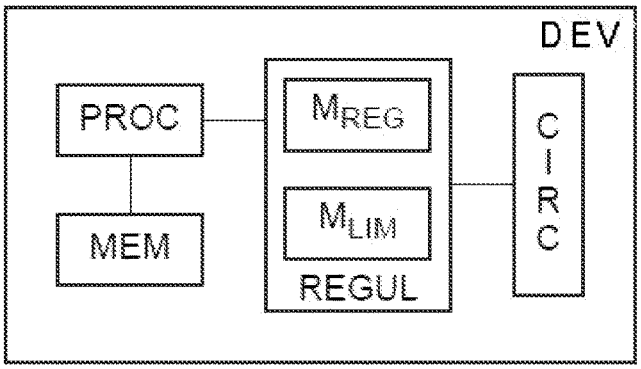
FIG. 7 is a device comprising a regulator according to an embodiment of the invention.

A device is described with reference to FIG. 7, comprising a regulator of the invention. This device can be of various types. In fact it can be any device in which an LDO regulator is used.

In this device DEV, there is a memory MEM, in particular for storing a computer program according to the invention, a processor PROC for implementing this program, a regulator REGUL, and a unit CIRC to which is supplied the regulated voltage provided by the regulator. The regulator comprises a regulating unit $M_{REG}$ and an output current limiting unit $M_{LIM}$.

Of course, the invention is not limited to the embodiments described above. It extends to all equivalent variations.

The invention claimed is:

1. A low-dropout voltage regulator comprising:

an output terminal to provide an output voltage regulated as a function of a reference voltage and to provide an output current; and an output current limiting unit comprising:

an output current replication module to provide a mirror current of the output current, a comparison module to compare the mirror current with a reference current, the comparison module comprising:

a first input coupled with a first electric potential which is a function of the output voltage and the intensity of the mirror current, and a second input coupled with a second electric potential which is a function of the output voltage and the intensity of the reference current; and a feedback module to limit the output current when the mirror current is greater than the reference current;

wherein both the mirror current and the reference current are injected into the output terminal.

2. The regulator according to claim 1, wherein:

the output terminal is the drain of a first PMOS power transistor, the output current replication module comprises a second PMOS transistor paired with the first transistor, the gate of the first transistor being connected to the gate of the second transistor and the source of the first transistor being connected to the source of the second transistor, the output of the comparator is coupled to the gates of the first and second transistors.

3. The regulator according to claim 2, further comprising:

a first resistor arranged between the output terminal and the first input of the comparator, and a second resistor arranged between the output terminal and the second input of the comparator.

4. A device comprising:

a low-dropout voltage regulator comprising:

an output terminal to provide an output voltage regulated as a function of a reference voltage and to provide an output current; and an output current limiting unit comprising:

an output current replication module to provide a mirror current of the output current, a comparison module to compare the mirror current with a reference current, the comparison module comprising:

a first input coupled with a first electric potential which is a function of the output voltage and the intensity of the mirror current, and a second input coupled with a second electric potential which is a function of the output voltage and the intensity of the reference current, and a feedback module on the regulator to limit the output current when the mirror current is greater than the reference current;

wherein both the mirror current and the reference current are injected into the output terminal.

5. A method for controlling a low-dropout voltage regulator comprising an output terminal for providing an output voltage regulated as a function of a reference voltage and for providing an output current, and an output current limiting unit, the method comprising:

replicating the output current to provide a mirror current of the output current, comparing the mirror current with a reference current by:

coupling a first input a comparison module with a first electric potential which is a function of the output voltage and the intensity of the mirror current, and coupling a second input of the comparison module with a second electric potential which is a function of the output voltage and the intensity of the reference current, providing feedback to the regulator to limit the output current when the mirror current is greater than the reference current, and injecting both the mirror current and the reference current into the output terminal.

* * * * *